US010399818B2

(12) United States Patent
Kattainen et al.

(10) Patent No.: US 10,399,818 B2
(45) Date of Patent: Sep. 3, 2019

(54) ARRANGEMENT AND A METHOD FOR TESTING ELEVATOR SAFETY GEAR

(71) Applicant: KONE Corporation, Helsinki (FI)

(72) Inventors: Ari Kattainen, Hyvinkää (FI); Antti Hovi, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 601 days.

(21) Appl. No.: 15/170,344

(22) Filed: Jun. 1, 2016

(65) Prior Publication Data

US 2016/0368736 A1 Dec. 22, 2016

(30) Foreign Application Priority Data

Jun. 16, 2015 (EP) ..... 15172270

(51) Int. Cl.

| | |
|---|---|
| ***B66B 1/36*** | (2006.01) |
| ***B66B 5/18*** | (2006.01) |
| ***B66B 5/00*** | (2006.01) |
| ***B66B 1/32*** | (2006.01) |
| ***B66B 1/34*** | (2006.01) |
| ***B66B 5/04*** | (2006.01) |
| ***B66B 5/24*** | (2006.01) |
| ***B66B 9/00*** | (2006.01) |

(52) U.S. Cl.

CPC ..... *B66B 5/18* (2013.01); *B66B 1/32* (2013.01); *B66B 1/3461* (2013.01); *B66B 5/0093* (2013.01); *B66B 5/044* (2013.01); *B66B 5/24* (2013.01); *B66B 9/00* (2013.01)

(58) Field of Classification Search

CPC ..... B66B 5/18; B66B 1/32; B66B 1/3461; B66B 5/0093; B66B 5/044; B66B 5/24; B66B 9/00

USPC ..... 187/288, 290, 391, 393, 293, 302, 305

See application file for complete search history.

(56) References Cited

U.S. PATENT DOCUMENTS

| | | | | |
|---|---|---|---|---|
| 4,568,909 A * | 2/1986 | Whynacht | ..... | B66B 5/0006 187/393 |
| 5,002,158 A * | 3/1991 | Ericson | ..... | B66B 5/04 187/254 |
| 5,233,139 A * | 8/1993 | Hofmann | ..... | B66B 5/0087 187/251 |

(Continued)

FOREIGN PATENT DOCUMENTS

| | | |
|---|---|---|
| CN | 1663902 A | 9/2005 |
| CN | 1784351 A | 6/2006 |

(Continued)

*Primary Examiner* — Anthony J Salata

(74) *Attorney, Agent, or Firm* — Birch, Stewart, Kolasch & Birch, LLP

(57) ABSTRACT

A control arrangement of an elevator includes a safety gear, an over speed governor with a rope which is connected to the safety gear, a stopping device for generating an actuating force to the safety gear, and a drive unit for driving the elevator apparatus. In order to facilitate easy and efficient maintenance, the control arrangement includes a controller for controlling a triggered sequence to involve activating of the stopping device for braking with the safety gear, and controlling the drive unit to drive the elevator apparatus during braking with the safety gear until the safety gear stops the elevator apparatus.

20 Claims, 2 Drawing Sheets

(56) References Cited

U.S. PATENT DOCUMENTS 5,299,661 A * 4/1994 Pramanik ..... B66B 5/044 187/373
5,492,200 A * 2/1996 Korhonen ..... B66B 5/044 187/350
6,026,936 A * 2/2000 Aulanko ..... B66B 5/18 187/372
6,109,398 A * 8/2000 Lempio ..... B66B 5/18 187/376
6,325,179 B1 * 12/2001 Barreiro ..... B66B 5/0037 187/393
7,222,698 B2 * 5/2007 Hanninen ..... B66B 5/0093 187/393
7,268,514 B2 * 9/2007 DeLange ..... B66B 1/30 187/291
7,537,090 B2 * 5/2009 Vantanen ..... B66B 5/04 187/286
7,617,911 B2 * 11/2009 Mattila ..... B66B 5/0031 187/288
7,721,852 B2 * 5/2010 Ishioka ..... B66B 7/08 187/313
7,931,127 B2 * 4/2011 Kondo ..... B66B 5/02 187/277
8,746,413 B2 * 6/2014 Schroeder-Brumloop ..... B66B 5/0093 187/288
9,027,714 B2 * 5/2015 Husmann ..... B66B 5/18 187/373
9,061,864 B2 * 6/2015 Spirgi ..... B66B 5/0037
2007/0181378 A1 8/2007 Kigawa et al.
2008/0067011 A1 3/2008 Gremaud et al.
2010/0154527 A1 * 6/2010 Illan ..... B66B 5/0093 73/121
2016/0039636 A1 * 2/2016 Kattainen ..... B66D 5/30 187/393

FOREIGN PATENT DOCUMENTS

CN 101092223 A 12/2007
CN 100537389 C 9/2009
CN 102556797 A 7/2012
CN 104495547 A 4/2015
CN 104495563 A 4/2015
EP 1 739 046 A1 1/2007

* cited by examiner

Legend:
1 - safety gear
2 - elevator apparatus
3 - vertical guide rail
11- drive unit
12- overspeed governor
13 - rope
14 - pulley
15 - mechanism
16 - rods
17 - controller
18 - detector
19 - stopping device
20 - communication link
21 - service center
22 - elevator installation site
23 - 26 - sensor

ARRANGEMENT AND A METHOD FOR TESTING ELEVATOR SAFETY GEAR

BACKGROUND OF THE INVENTION

Field of the Invention

This invention relates to a solution for maintaining an elevator and in particularly to safety devices of the elevator.

Description of Prior Art

For safety reasons an elevator has safety devices for stopping the movement of a falling elevator car. These safety devices include an over speed governor which can be located in several alternative locations such as in the elevator hoistway or in a machine room. The over speed governor utilizes a rope which moves with the elevator car and which is connected to a safety gear in order to provide an actuating force to the safety gear when needed.

In case the elevator car moves downwards with a higher speed than allowed, the over speed governor prevents movement of the rope. As the rope is connected to a safety gear of an elevator car that moves downwards while the rope is prevented from moving, an actuating force caused by the speed difference is provided to the safety gear. Due to this actuating force, the safety gear starts to brake the elevator car until it comes to a stop.

In order for the above mentioned safety devices to work appropriately when needed, it is necessary regularly check the condition of them and to give them the maintenance work they need. This is challenging as it requires service personnel to visit the installation site of the elevator and to carry out the necessary procedures to determine that everything works as intended.

SUMMARY OF THE INVENTION

In order to solve the above mentioned drawback a solution is needed which makes it possible to maintain an elevator in a new and efficient way.

The triggering of a sequence where the safety gear is activated to brake the elevator apparatus, such as an elevator car or a counterweight, while the drive unit is controlled to drive the elevator apparatus until the safety gear stops the elevator apparatus makes it possible to obtain a simple and cost efficient solution.

Preferred embodiments are disclosed in the dependent claims.

BRIEF DESCRIPTION OF DRAWINGS

In the following one or more embodiments will be described in closer detail by way of example and with reference to the attached drawings, in which.

DESCRIPTION OF AT LEAST ONE EMBODIMENT

Figure 1:
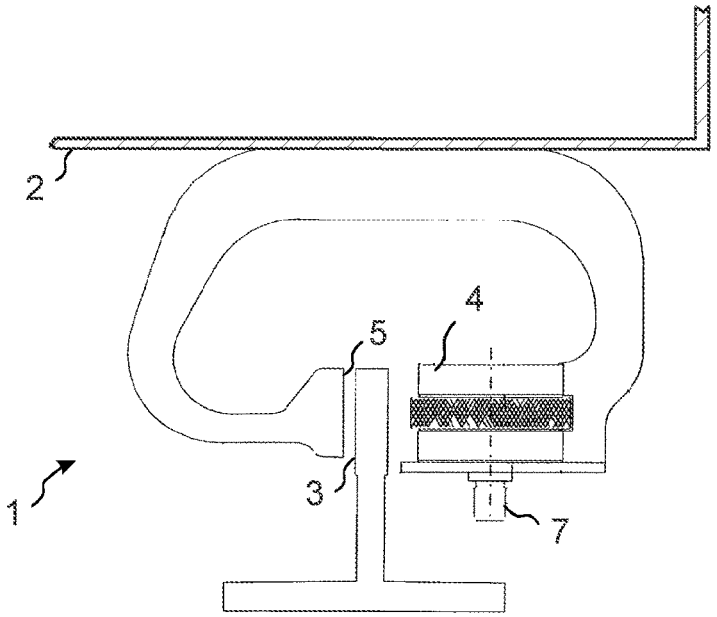
FIGS. 1 and 2 illustrate a safety gear.
Figure 2:
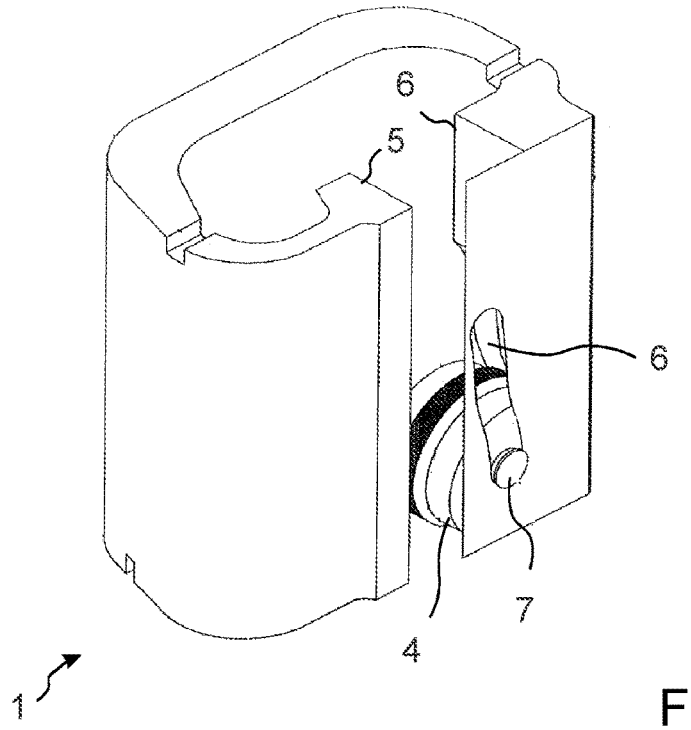

FIGS. 1 and 2 illustrate a safety gear 1. FIG. 1 illustrates the safety gear 1 and a guide rail 3 from above and FIG. 2 mainly from the side.

The illustrated safety gear 1 is of a sliding type, as it during use in an elevator apparatus 2 slides along a vertical guide rail 3 mounted in an elevator hoistway. The elevator apparatus may consist of an elevator car or of a counterweight, however, for simplicity in the illustrated examples only an elevator car is illustrated. The illustrated safety gear 1 has a roller shaped force element 4 though alternatively a wedge shaped force element could be in use.

As long as the safety gear 1 does not brake the elevator apparatus 2, the force element 4 remains in the position illustrated in FIG. 2, in other words in the lower part of the safety gear 1. With the force element in this position the guide rail 3 has enough space between the force element 4 and the braking surface 5 facing the force element such that no braking occurs while the safety gear 1 slides along the guide rail 3.

However, once braking with the safety gear 1 is desired, the force element 4 is brought upwards in FIG. 2. As can be seen from FIG. 2, the distance between the opposite surfaces 5 and 6 of the safety gear 1 decrease upwards. Consequently, once the force element 4 moves upwards it comes into contact with the guide rail 3 with the consequence that the force element 4 becomes jammed between the guide rail 3 and the surface 6 of the safety gear 1. In this position the force element efficiently brakes the elevator apparatus 2 until the elevator apparatus stops.

The upward movement of the force element 4 may be implemented via the shaft 7 for instance. When this shaft 7 is moved upwards during downwards movement of the elevator apparatus 2, the safety gear 1 brakes. In order to release the force element 4 after such braking, the force element 4 may be moved downwards via the shaft 7 simultaneously as the elevator apparatus 2 is moved upwards via its drive unit, for instance.

Figure 3:
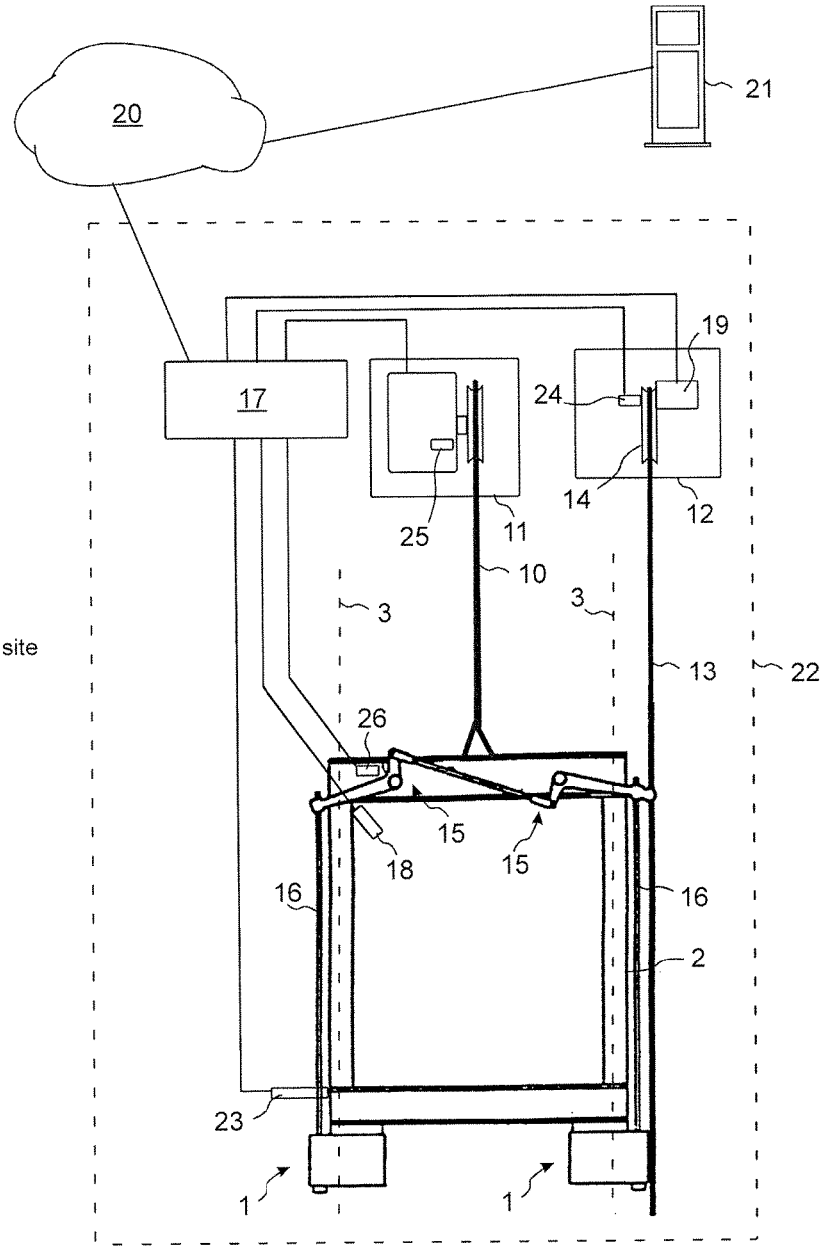
FIG. 3 illustrates an elevator where the safety gear of FIGS. 1 and 2 can be utilized.

FIG. 3 illustrates an elevator with an elevator apparatus 2. This elevator may be provided with one or more of the safety gears 1 illustrated in FIGS. 1 and 2 for braking the elevator apparatus with the aid of vertical guide rails 3. However, it is also possible to utilize other types of safety gears in the elevator of FIG. 3.

The elevator apparatus 2 is provided with a drive unit 11 for driving the elevator apparatus 2 upwards and downwards. Such a drive unit 11 may include an electric motor, a frequency converter and a traction pulley pulling a hoisting rope 10, for instance. In the illustrated example the drive unit 11 has by way of example been located above the elevator apparatus 2 in the elevator hoistway, but the drive unit 11 could also be located somewhere else such as at the side of the vertical path of the elevator apparatus 2 or in a location below the elevator hoistway, for instance.

In FIG. 3 an over speed governor 12 is arranged in the upper part of the elevator hoistway, though the over speed governor 12 could alternatively be located somewhere else such as in a machine room, for instance. The over speed governor 12 has a rope 13 arranged to run via an rotatable pulley 14. In the illustrated example this rope 13 is fixed to the elevator apparatus 2 at a mechanism 15 which via two rods 16 is attached to the shafts 7 of the respective safety gears 1 to move the force elements 14 of the safety gears 1. Therefore, when the pulley 14 is allowed to rotate freely, the rope 13 moves along with the elevator apparatus 2 and no actuating force is transferred via the rope 13 to the safety gears 1. At that stage no braking occurs by means of the safety gears 1.

The over speed governor 12 may be provided with an activation means based on centrifugal forces, for instance. In that case once the elevator apparatus 2, or actually the rope 13, moves downwards with a speed exceeding a predetermined speed limit, centrifugal forces activate a stopping device 19 in the over speed governor 12 by locking the pulley 14 in order to prevent it from rotating. At that stage the speed of the rope 13 decreases while the elevator apparatus 2 still moves downwards with the same speed. This speed difference generates an actuating force transferred by the rope 13 to the safety gears 1 via the mechanism 15 and the rods 16. Due to the actuating force, the safety gears 1 start to brake, as has been explained in connection with FIGS. 1 and 2, for instance.

In the illustrated embodiment the elevator comprises a control arrangement including a controller 17. This controller may be implemented with circuitry or as a combination of circuitry and one or more computer programs. The controller 17 may be included for the sole purpose of controlling the sequence that will be explained in the following. Alternatively, the same controller 17 may have also other tasks, such as controlling the drive unit 11 and other devices of the elevator while it is being ordinarily used.

The controller 17 preferably initially ensures that the elevator apparatus 2 is not in use, in particular, if this information is not previously available via other sources. Depending on the implementation a person present in an elevator may be detected by a motion detector, pressure detector, a load weighing device or by the momentum of the motor. This may involve use of a detector 18 suitable for detecting whether or not he elevator apparatus 2 is empty at that moment. Such a detector may consist of a motion detector within the elevator car to detect persons, or of a device in connection with the floor or the suspension of the elevator car that can be used to determine if the elevator car contains additional weight, for instance.

While the elevator apparatus 2 has stopped in the elevator hoistway and the controller 17 determines it appropriate to proceed with the sequence, the stopping device 19 is activated in order to prevent movement of the rope 13 and to generate an actuating force for the safety gear 1. In the illustrated embodiment it is by way of example assumed that the stopping device 19 acts specifically on the pulley 14 in order to prevent it from rotating. In that case the stopping device 19 may be implemented to include a solenoid, for instance, which solenoid once activated via a suitable mechanism creates a braking force for the pulley 14. However, is some embodiments it may be possible to utilize a stopping device acting directly of the rope 13, for instance.

Once the stopping device 19 is activated the controller 17 controls the drive unit 11 to drive the elevator apparatus 2 downwards. Due to this, as the stopping device 19 prevents movement of the rope 13, movement of the elevator apparatus 2 generates an actuating force via the mechanism 15 and the rods 16 to the safety gear 1 and the safety gear 1 starts to brake. While the safety gear brakes, the controller 17 controls the drive unit to drive the elevator apparatus downwards, until the controller 17 determines that the safety gear 1 has stopped the elevator apparatus 1. Depending on the implementation, the controller 17 may receive information from sensors in the elevator hostway about when the elevator apparatus 13 has physically stopped, or from the drive unit 11 about when the momentum at the motor has reached a level indicating that the weight of the elevator apparatus 2 is no longer carried by the drive unit 11, for instance.

The controller 17 may be configured to trigger the sequence in predetermined situations. One alternative is that the sequence is triggered regularly, such as a few times each year, when the elevator is not in use. An advantage with such a solution is that the stopping device 19, the mechanism 15 and the safety gears 1 are regularly used which prevents them from being stuck due to dirt or rust, for instance.

In the illustrated example it is by way of example assumed that the controller is connected via a communication link 20, such as via the Internet to a service center 21 located outside of the elevator installation site 22. Such a service center 21 may handle maintenance of a plurality of elevators installed at different installations sites. In that case service personnel or an automatic elevator management system may trigger the sequence by sending a control command to the controller 17 at the elevator installation site 22 via this communication link 20.

Once the controller 17 has determined that the safety gear 1 has stopped the elevator apparatus 1, the controller may be configured to end the sequence by deactivating the stopping device 19 and by controlling the drive unit to move the elevator apparatus 2 upwards such that the braking with the safety gears 1 may end. Thereby the status of the elevator can be normalized such that the elevator is ready for normal use.

In order to obtain as much information as possible about the elevator, the controller 17 may be configured to record and obtain various measurement results during the sequence. The controller 17 may store such results in a local memory to be used by service personnel visiting the installation site 22 of the elevator. Alternatively the controller 17 may be configured to transmit measurement results via the communication link 20 to the service center 21. In this way real time information describing the operating status of the safety gear and the over speed governor can be made available at the service center 21.

During the sequence, various measurement results may be obtained. In order to determine how well the safety devices work, a measurement result describing the change in the height position, in other words the distance that the elevator apparatus 2 moves downwards during the sequence is desirable. Such a measurement result can be compared to similar measurement results obtained previously for the same elevator or other other elevators of the same type. One alternative is to utilize a sensor 23 located in the elevator hoistway to obtain the height position of the elevator apparatus 2 at different phases of the sequence, such as when the sequence begins and when it ends. During ordinary use of the elevator, such a sensor 23 may also be used to ensure that the elevator car is located at the correct height position in relation to the floor.

If the illustrated example, a sensor 24 is also arranged at the pulley 14 to measure the rotation of the pulley 14 during the sequence. When this information is compared to information from a sensor 25 in the drive unit 11 of the elevator that indicates a distance the drive unit has moved the elevator apparatus during the sequence, it is possible to determine the amount of slippage of the rope 13 at the pulley 14.

Additionally, the mechanism 15 may be provided with a sensor 26 to detect the moment of time when the mechanism 15 is actuated. When this moment of time is compared to information available from sensor 23 or from the drive unit 11 about the moment of time that the elevator apparatus 2 has stopped, it becomes possible to determine the time period needed by the safety gears 1 to stop the elevator apparatus from the moment the mechanism 15 was actuated.

It is to be understood that the above description and the accompanying figures are only intended to illustrate the present invention. It will be obvious to a person skilled in the art that the invention can be varied and modified without departing from the scope of the invention.

The invention claimed is:

1. A testing arrangement of an elevator, comprising:

at least one safety gear configured to apply a braking force to an elevator apparatus;

an over speed governor with an over speed rope fixed to the elevator apparatus at a mechanism attached to a respective safety gear, the braking force being initiated by an actuating force transferred via the over speed rope to the mechanism;

an actuator configured to prevent movement of the over speed rope for generating the actuating force to each safety gear via the mechanism;

a drive unit configured to pull a hoisting rope connected to the elevator apparatus for driving the elevator apparatus; and a controller, the controller being configured to perform the following sequence:

activate the actuator to prevent movement of the over speed rope and to cause, via the mechanism, each safety gear to apply a braking force to the apparatus; then control the drive unit to drive the elevator apparatus while each safety gear is applying the braking force to the elevator apparatus; then control the drive unit to stop driving the elevator apparatus once the elevator apparatus stops due to the braking force applied from the at least one safety gear; then measure the distance the elevator apparatus has traveled from the activation of the actuator until the elevator apparatus stopped; and then compare the measured distanced to a predetermined distance to determine the operating condition of the at least one safety gear, wherein the at least one safety gear is only activated via the over speed rope.

2. The testing arrangement according to claim 1, wherein the testing arrangement comprises a detector configured to determine whether or not the elevator apparatus is empty, and wherein the controller is responsive to the detector for performing the sequence only when the elevator apparatus is empty.

3. The testing arrangement according to claim 1, wherein the controller is configured to regularly perform the sequence.

4. The testing arrangement according to claim 1, wherein the controller is configured to perform the sequence in response to a control command received via a communication link.

5. The testing arrangement according to claim 1, wherein the testing arrangement comprises a sensor for determining a height position of the elevator apparatus at different phases of the sequence, and wherein the controller controls the actuator based on the determined height.

6. The testing arrangement according to claim 1, wherein the over speed rope engages a rotatable pulley, and wherein the over speed governor is configured to activate the actuator to lock the pulley for preventing movement of the over speed rope and activating the at least one safety gear.

7. The testing arrangement according to claim 6, wherein the pulley is provided with a sensor for measuring the rotation of the pulley during the sequence to provide first information, wherein the drive unit is provided with a sensor for measuring a distance the drive unit has moved during the sequence to provide second information, and wherein controller compares the first information to the second information to determine an amount of slippage of the over speed rope.

8. The testing arrangement according to claim 1, wherein the controller is configured transmit the measurement results obtained during the sequence via a communication link to a service center.

9. The testing arrangement according to claim 1, wherein each safety gear applies a braking force to the elevator by gripping a guide rail extending along the travel path of the elevator apparatus.

10. A method for testing an elevator, wherein the elevator comprises at least one safety gear, an over speed governor having an over speed rope fixed to an elevator apparatus at a mechanism, an actuator, a drive unit configured to pull a hoisting rope connected to the elevator apparatus and a controller, the method comprising performing the following sequence, via the controller:

activating the actuator to prevent movement of the over speed rope and to cause, via the mechanism, each safety gear to apply a braking force to the apparatus; then controlling the drive unit to drive the elevator apparatus while each safety gear is applying the braking force to the elevator apparatus; then controlling the drive unit to stop driving the elevator apparatus once the elevator apparatus stops due to the braking force applied from the at least one safety gear; then measuring the distance the elevator apparatus has traveled from the activation of the actuator until the elevator apparatus stopped; and then comparing the measured distanced to a predetermined distance to determine the operating condition of the at least one safety gear, wherein the at least one safety gear is only activated via the over speed rope.

11. The method according to claim 10, wherein the method comprises performing the sequence for the elevator via a communication link.

12. The method according to claim 10, further comprising the steps of:

obtaining measurement values which indicate movement of the elevator apparatus during the sequence; and transmitting the obtained measurement values via a communication link to a separate device.

13. The method according to claim 1, wherein the controller regularly performs the sequence.

14. The testing arrangement according to claim 2, wherein the controller performs the sequence in response to a control command received via a communication link.

15. The testing arrangement according to claim 2, wherein the over speed rope runs via a rotatable pulley, and wherein the activation of the actuator locks the rotatable pulley for preventing movement of the over speed rope and activating the at least one safety gear.

16. The testing arrangement according to claim 1, wherein the at least one safety gear includes two safety gears.

17. The testing arrangement according to claim 1, wherein the mechanism moves two rods, each rod being attached to a shaft of a respective safety gear to initiate the application of the braking force via an actuating force transferred via the over speed rope to the mechanism, wherein the actuator prevents movement of the over speed rope to generate the actuating force to each safety gear via the respective rod.

18. The method according to claim 10, wherein the over speed rope runs via a rotatable pulley, and wherein the activation of the actuator locks the rotatable pulley for preventing movement of the over speed rope and activating the at least one safety gear.

19. The method according to claim 10, wherein the at least one safety gear includes two safety gears.

20. The method according to claim 10, wherein the mechanism moves two rods, each rod being attached to a shaft of a respective safety gear to initiate the application of the braking force via an actuating force transferred via the over speed rope to the mechanism, wherein the actuator prevents movement of the over speed rope to generate the actuating force to each safety gear via the respective rod.

* * * * *